US006402626B1

(12) United States Patent
Beaty

(10) Patent No.: US 6,402,626 B1
(45) Date of Patent: Jun. 11, 2002

(54) BUCKING MACHINE

(76) Inventor: William A. Beaty, Rt. 2, Box 88, Cheyenne, OK (US) 73628

( * ) Notice: Subject to any disclaimer, the term of this patent is extended or adjusted under 35 U.S.C. 154(b) by 0 days.

(21) Appl. No.: 09/900,061

(22) Filed: Jul. 9, 2001

(51) Int. Cl.[7] ..... A63G 13/06
(52) U.S. Cl. ..... 472/96; 472/97; 472/100; 434/247
(58) Field of Search ..... 472/95, 96, 97, 472/100, 104, 105; 434/247, 55; 446/313

(56) References Cited

U.S. PATENT DOCUMENTS 2,889,148 A * 6/1959 Lyles ..... 472/97
2,908,500 A * 10/1959 Yetter ..... 472/97
2,922,649 A * 1/1960 Hawkins ..... 472/97
3,997,979 A * 12/1976 Turner ..... 434/247
4,519,787 A * 5/1985 Williams ..... 446/313
5,085,425 A * 2/1992 Collins et al. ..... 472/97
5,180,338 A * 1/1993 Pinto ..... 472/101
5,429,515 A * 7/1995 Greenwood ..... 434/247
5,813,864 A * 9/1998 Ikuta ..... 434/247
6,059,666 A * 5/2000 Ohara et al. ..... 463/36

* cited by examiner

*Primary Examiner*—Kien T. Nguyen
(74) *Attorney, Agent, or Firm*—Robert K. Rhea; Bill D. McCarthy

(57) ABSTRACT

A rodeo rider training apparatus is formed by a retractable wheel horizontal base frame supporting a spin wheel, a motor spin wheel driving apparatus and a spin shaft supporting a bucking apparatus in turn supporting a rider support for simulating a bucking action of a horse or bull while the spin wheel rotates the bucking apparatus in a selected direction. A divided circular pad horizontally surrounds the vertical axis of the bucking apparatus and rider support and spins therewith within a central portion of a surrounding air mattress providing padding, with the circular pad, for receiving a rider falling from the rider support thus allowing the falling rider to spin with the device until he can exit the spin pad to the air mattress, out of the way of the bucking apparatus.

5 Claims, 3 Drawing Sheets

BUCKING MACHINE

CROSS REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to bucking machines which simulate the bucking action of a horse or bull and simultaneously spins as is typical of rodeo bulls.

1. Field of the Invention

2. Description of the Prior Art

There are numerous rocking or bucking machines presently in use or available on the open market primarily targeting small children as an amusement device.

Other machines of the prior art are intended primarily for adults and/or cowboys in which the bucking action is considerably improved over the small units located in front of many business establishments for the amusement of children and in which the device angularly rotates or spins to simulate the action of a bucking bull.

U.S. Pat. No. 3,997,979 issued Dec. 21, 1976 to Turner for Rodeo Training Device and U.S. Pat. No. 4,519,787 issued May 28, 1985 are good examples of rodeo training bucking machines which includes a spin action simulating a bucking bull.

One disadvantage of each of the above named patents comprises the danger of the participant, after being thrown from the rider support to the base or surface of the earth, being injured by the spinning action of the rider support contacting him before he has an opportunity to move out of the way.

The bucking machine apparatus of this invention overcomes this problem by providing a diametrically divided circular pad of substantial thickness and diameter, at least as great as the overall length of the rider support, which surrounds the shaft or spindle supporting the rider support and spins with the rider support and its bucking mechanism thus insuring the rider is in no danger of being hit by the rider support since the rider and the rider support all rotate in the same direction simultaneously.

Further this circular pad is surrounded by an air filled mattress substantially greater in overall horizontal dimensions, so that a rider may roll off the circular pad onto the mattress and exit the position of the bucking bull without physical danger.

U.S. Pat. No. 2,722,418 issued Nov. 1, 1955 to Small for Hobby Horse and U.S. Pat. No. 2,889,148 issued Jun. 2, 1959 to Lyles for Mechanical Horse are believed good examples of the state-of-the-art relating to amusement riding devices.

BRIEF SUMMARY OF THE INVENTION

A retractable wheel horizontal base frame supports a spin wheel and reversible motor spin wheel driving apparatus having an upstanding spin shaft eccentrically projecting upward from the spin wheel and supporting a bucking apparatus in turn supporting a rider support for simulating a bucking action of a horse or bull while the spin wheel rotates the bucking apparatus in a selected direction.

A divided circular pad horizontally surrounds the vertical axis bucking apparatus and rider support and spins therewith within a central portion of a surrounding air mattress providing padding, with the circular pad, for receiving a rider falling from the rider support thus allowing the falling rider to spin with the device until he can exit the spin pad to the air mattress out of the way of the bucking apparatus.

The principal object of this invention is to provide an amusement and training device simulating the action of a bucking animal or rodeo bull and providing a safety feature minimizing the danger of a thrown rider being injured by the spinning action of the rider support.

DETAILED DESCRIPTION OF THE INVENTION

Figure 1:
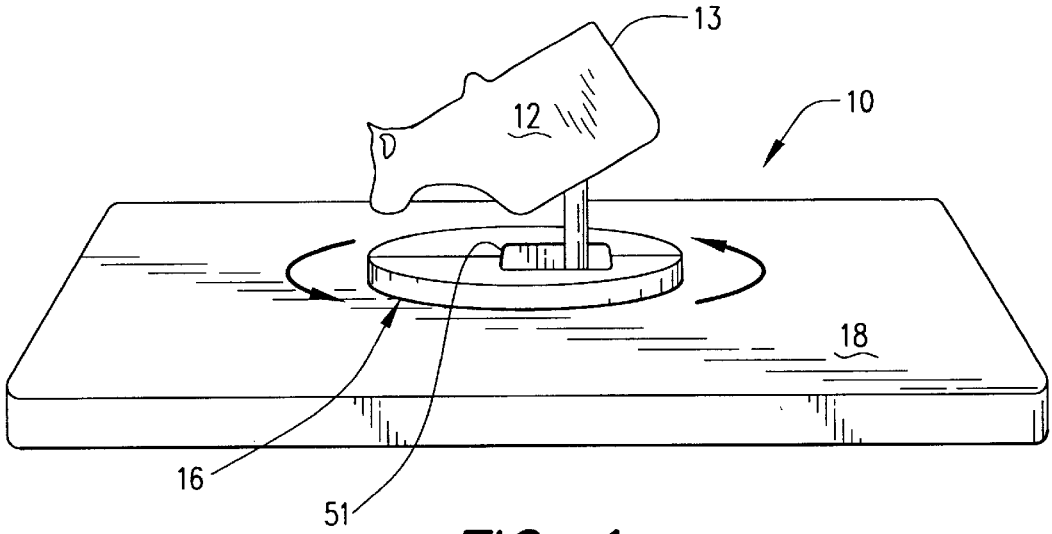
FIG. 1 is a perspective view of the device illustrating one direction of spin of the rider support and safety pad.

The reference numeral 10 indicates the bucking apparatus comprising a rider support 12 having a rearward end portion 13 vertically reciprocated about a horizontal axis by a bucking mechanism 14 (FIG. 2) and having an underlying horizontal circular resilient pad 16 which angularly rotates with the rider support 12 and is surrounded by a fixed position air mattress 18 extending horizontally outward from the rotating pad.

The reference numeral 20 indicates a horizontal rectangular open base frame resting on the surface of the earth 22 and having a pair of retractable wheels 24 raised and lowered by normally horizontal respective pairs of arms 27 pivoted about a wheel supporting shaft 25 by a pressure cylinder 26 which raises and lowers respective ends of the wheel supporting arms 27 so that the apparatus 10 may be moved in a mobile manner by a trailer hitch 28, having a caster wheel 29 supporting the forward end of the frame 20. The frame 20 centrally supports a horizontal spin wheel 30 rotatable around its spindle or axis 32. The spin wheel 30 is driven by a reversible motor M1 and transmission 34 connected with a drive pulley 36 having a belt 38 extending around the drive pulley and the spin wheel for angularly rotating the rider support 12 and its underlying safety pad 16 in a selected direction.

A substantially hexagonal frame 40 horizontally underlies the safety pad 16 and angularly rotates about the axis of the spin wheel 30 while supporting the safety pad 16 overlying the rotatable frame 40. The frame 40 has a plate 44 (shown fragmentarily in FIG. 3) which overlies the spin wheel 30 in underlying relation with respect to the rotating frame 40 for connecting the spin wheel with the rotatable frame 40 and angularly rotating the latter with the spin wheel. A standard 46, eccentrically mounted on the plate 44 with respect to the axis 32 of the spin wheel, extends upwardly through the circular pad 16 to support the bucking mechanism 14, as will presently be described.

Figure 3:
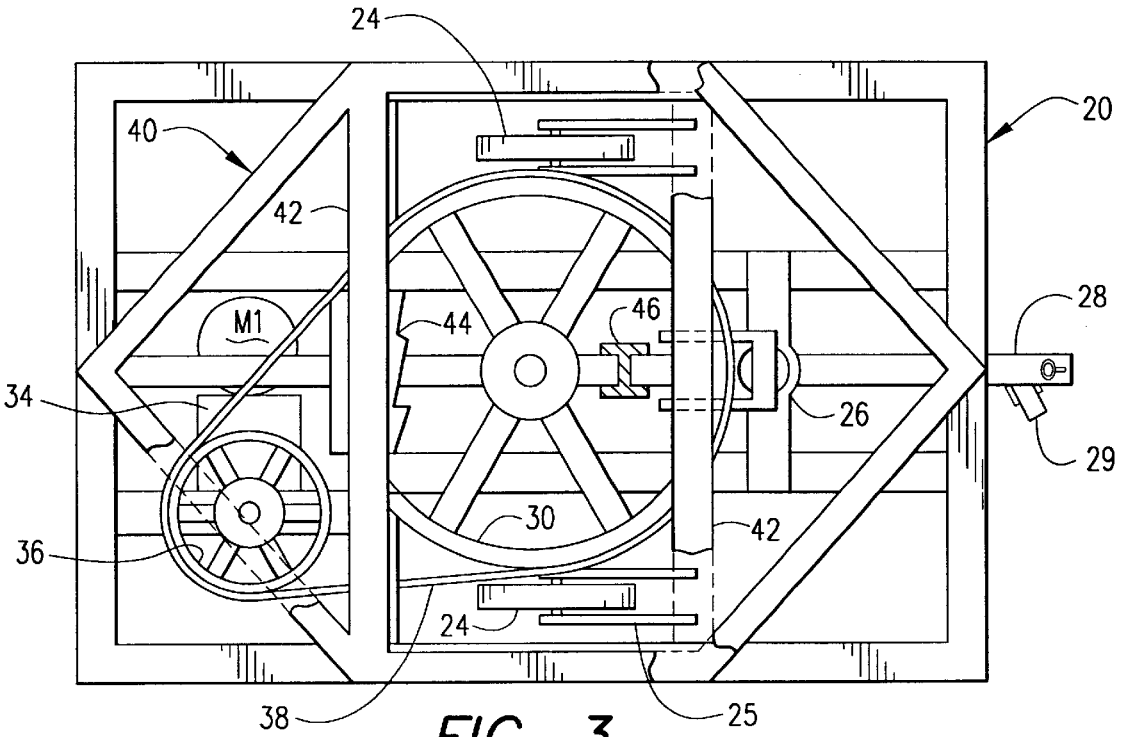
FIG. 3 is a top view of the base frame and an overlaying rotating frame, as viewed when looking in the direction of the arrows 3—3 of FIG. 2.
Figure 4:
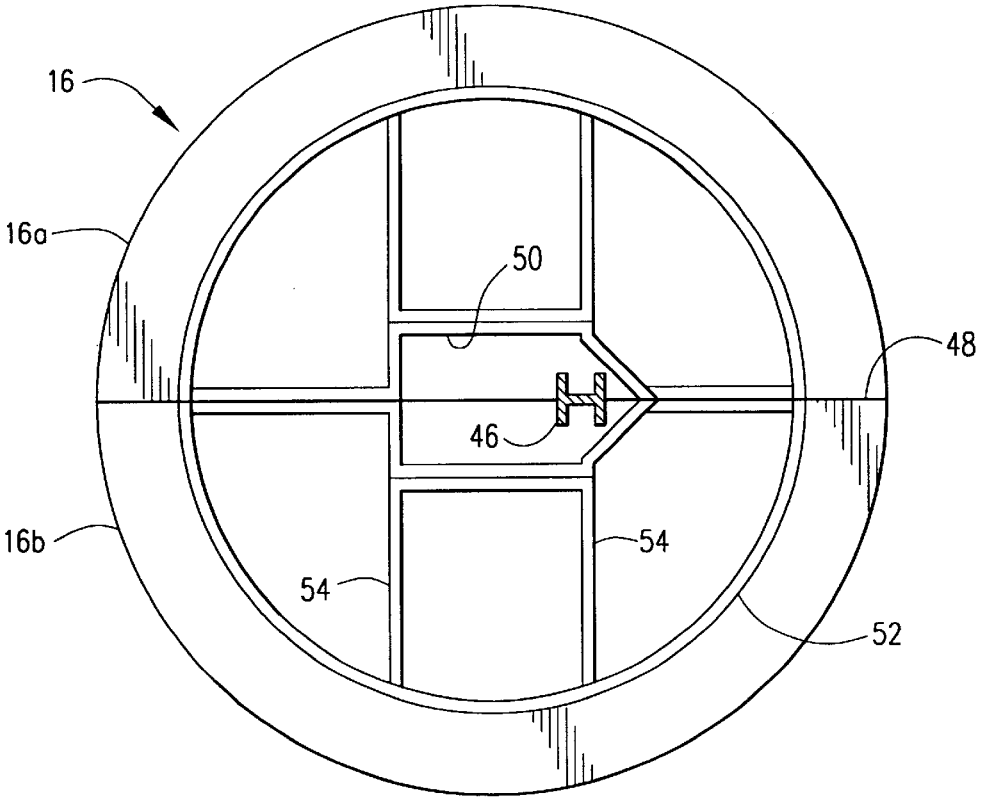
FIG. 4 is a bottom view of the divided circular safety pad, when looking in the direction of the arrows 4—4 of FIG. 2.

The safety pad 16 is a selected diameter sufficient to support a rider when falling from the rider support and be angularly rotated with the spin wheel on the safety pad, thus eliminating the danger of being struck by the rider support 12 as it is angularly rotated. The safety pad 16 is diametrically divided along the line 48 (FIG. 4) to form opposite halves 16*a* and 16*b* and describe a central opening 50 surrounding the standard 46 and equipment housing 51. The safety pad 16 is supported on the rotating frame 40 by a horizontal circular frame 52 (FIG. 4) of smaller diameter than the diameter of the safety pad. The circular frame being transversely divided in cooperative relation with respect to the diametric division of the safety pad 16. The pad support frame 52 is provided with a pair of parallel support members 54 which overlie the rotating frame 40 transverse support members 42 (FIG. 3).

Figure 2:
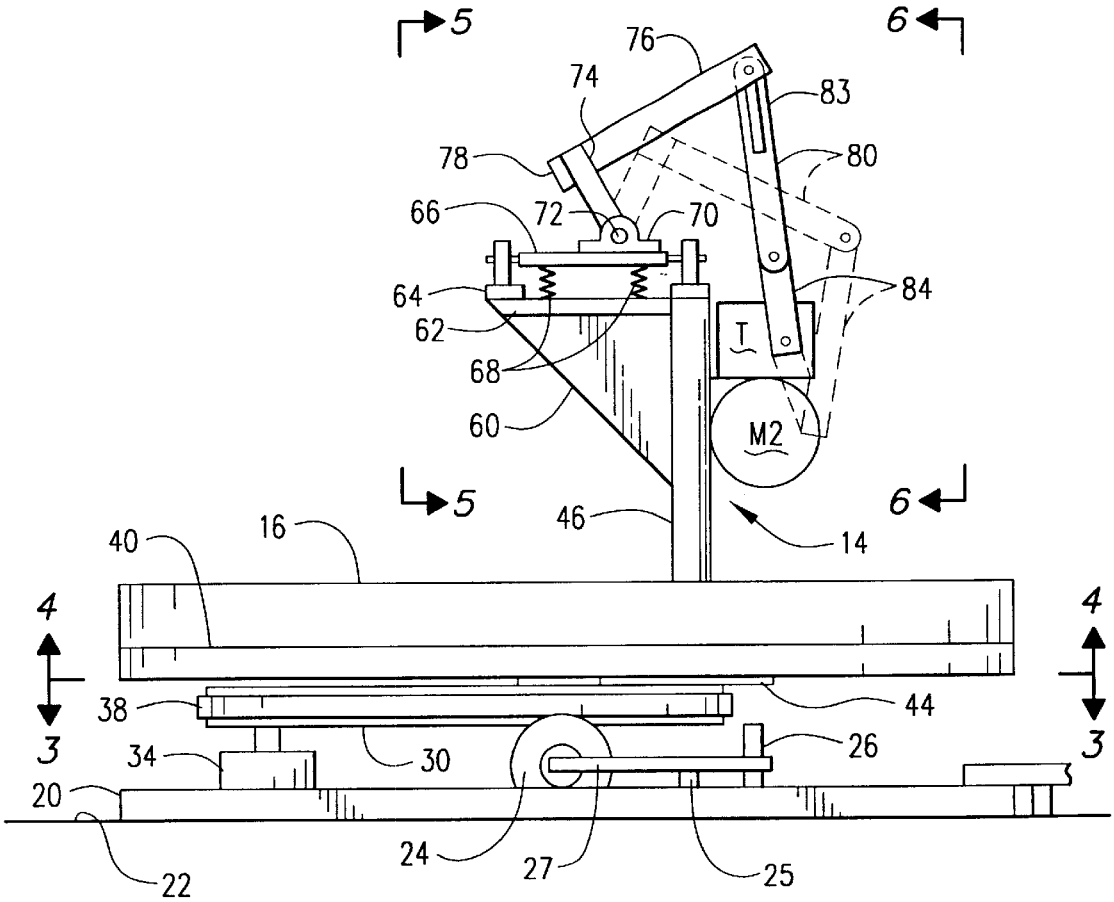
FIG. 2 is a side elevational view of the apparatus as seen in FIG. 1 with the air mattress and rider support removed for clarity.
Figure 5:
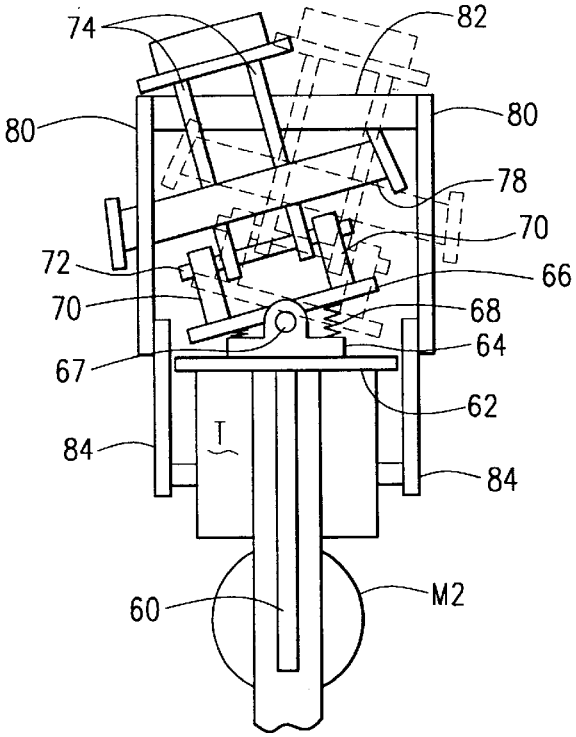
FIG. 5 is a fragmentary elevational view to a larger scale illustrating the lateral movement of the bucking mechanism, when looking in the direction of the arrows 5—5 of FIG. 2; and, FIG. 6 is a fragmentary elevational view to a similar scale of the rearward portion of the bucking mechanism, when looking in the direction of the arrows 6—6 of FIG. 2.

Referring now to FIGS. 2 and 5 the reference numeral 60 indicates a vertical web secured to the upper end portion of the standard 46 and projecting toward the center of the safety pad 16 above the opening 50 therein. The web 60 horizontally supports a transversely disposed first plate or platform 62 having a pair of pilot bearings 64 mounted at respective ends thereof for journalling a shaft 67 secured to the undersurface of a second platform 66. The platform 66 is normally maintained in horizontal parallel relation with the support 62 by two pairs of longitudinally spaced compression springs 68 which are compressed in right or left directions, with respect to the rider support 12, by the mass thereof and the rider leaning in a right or left direction, which simulates the sun-fishing action of a bucking bronco. Similarly, a second pair of pilot bearings 70 on respective sides of the plate 66 journal a shaft 72 pivotally supporting the depending end portions 74 of a pair of laterally spaced L-shaped, in side elevation, upwardly extending arms 76 having a plate 78 intermediate their upper end portions which underlie the rider support 12 when placed thereover.

Figure 6:
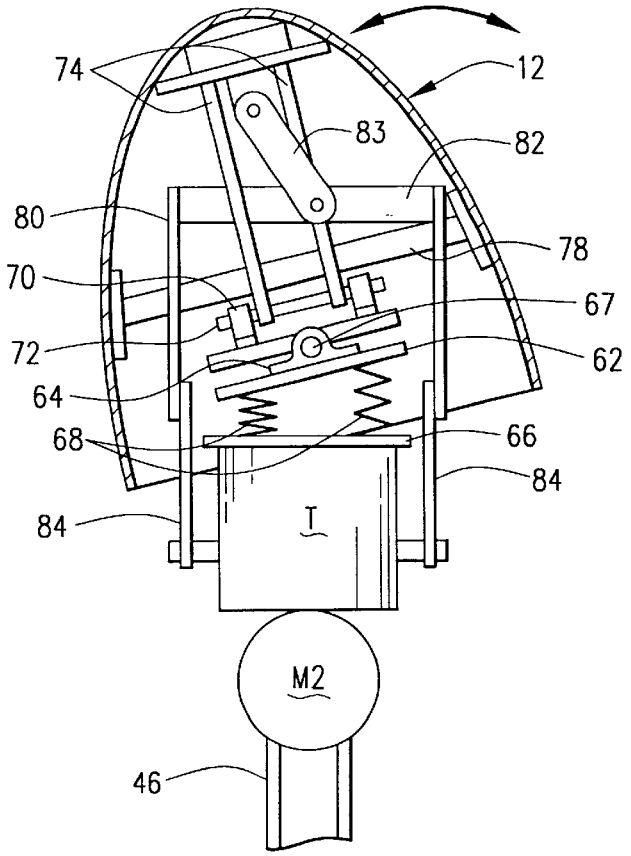

A pair of arms 80 are rigidly connected in spaced relation at one end portion with a bight portion 82 and in turn pivotally connected at their other end portions with a pair of crank arms 84 driven by a transmission T operated by a reversible motor M2 mounted on the standard 46. The bight portion 82 is centrally connected with the rider support plate 78 by a pair of parallel links 83 only one being shown, (FIGS. 3 and 6) connected at respective ends with the bight portion 82 and rider plate support 78 which permits lateral tilting motion of the rider support members by the compression and expansion of the springs 68 as the rider support 12 is moved in a tight or left direction.

OPERATION

In operation of the bucking apparatus 10 and assuming the mattress pad 18 is overlying the base frame and encompassing the rotating frame 40 and safety pad 16 with the bucking apparatus standard 46 projecting upwardly through the safety pad 16, such as is illustrated by FIG. 1. Assuming also that the angular rotation of the safety pad 16 and bucking apparatus 14 as well as the up and down bucking action of the rider support 12 is accomplished by connecting the motors M1 and M2 to a source of electricity through control switches, not shown. A rider mounts the rider support 12 or may place a saddle, not shown, on the saddle support if desired. When the rider is ready the person operating the apparatus closes current energizing switches, not shown and the bucking apparatus begins its action of up and down movement while being simultaneously rotated in a selected direction. In addition to the up and down bucking movement the rider support, by being unbalanced by the rider, may tilt in a right or left direction compressing a respective pair of the springs 68 so that the rider support also tilts in the right or left direction. The bucking action continues for a specified length of time when the current is interrupted to cease operation of the bucking apparatus.

Obviously the invention is susceptible to changes or alterations without defeating its practicability. Therefore, I do not wish to be confined to the preferred embodiment(s) shown in the drawing(s) and described herein.

I claim:

1. A bucking machine for training a rodeo rider, comprising:

a horizontally disposed base frame;

a horizontally disposed angularly rotatable frame supported by said base frame in axial spaced relation;

an upright standard eccentrically supported by said rotatable frame, said standard being angularly rotatable, in either direction, independently of the direction of rotation of said rotatable frame;

a rider support having forward and rearward end portions simulating a portion of the torso of a rodeo animal;

reversible motor means operatively connected with said rotatable frame for angularly rotating the latter, in a selected direction; and, motor driven means supported by said standard and interposed between the rider support and the standard for sequentially vertically reciprocating respective end portions of the rider support in an up and down bucking action of a rodeo animal attempting to unseat a rider.

2. The bucking machine according to claim 1 and further including:

a first platform horizontally supported by said standard in underlying relation with respect to the forward end portion of the rider support;

a second platform pivotally supported by said first platform for lateral downward tilting movement about a horizontal axis;

and, resilient means interposed between said first and second plates.

3. The bucking machine according to claim 2 in which said resilient means comprises:

a plurality of helical springs.

4. The bucking machine according to claim 3 and further including:

a diametrically divided resilient safety pad axially surrounding said standard and having a radial dimension at least equal with the radial dimension described by the respective end portion of the rider support overlying and rotatable with said rotatable frame.

5. The bucking machine according to claim 4 and further including:

a fallen rider supporting stationary mattress having a central aperture freely surrounding the safety pad and extending outwardly therefrom a preselected distance and having a vertical dimension substantially equal with the vertical dimension between the surface of the earth and the upper limit of the safety pad.

* * * * *

UNITED STATES PATENT AND TRADEMARK OFFICE

CERTIFICATE OF CORRECTION

PATENT NO. : 6,402,626 B1
DATED : June 11, 2002
INVENTOR(S) : William A. Beaty

It is certified that error appears in the above-identified patent and that said Letters Patent is hereby corrected as shown below:

Column 3,
Line 52, "in a tight or left" should be -- in a right or left --

Signed and Sealed this

Sixth Day of May, 2003

JAMES E. ROGAN
*Director of the United States Patent and Trademark Office*